United States Patent [19]

Schlegel

[11] Patent Number: 4,783,103

[45] Date of Patent: Nov. 8, 1988

[54] VEHICLE DOOR LOCK ASSEMBLY

[75] Inventor: Christoph Schlegel, Wolnzach, Fed. Rep. of Germany

[73] Assignee: Audi AG, Fed. Rep. of Germany

[21] Appl. No.: 17,238

[22] Filed: Feb. 20, 1987

[30] Foreign Application Priority Data

Feb. 21, 1986 [DE] Fed. Rep. of Germany ..... 3605601

[51] Int. Cl.[4] ..... E05C 3/06

[52] U.S. Cl. ..... 292/216; 292/341.12; 292/DIG. 38; 292/DIG. 56

[58] Field of Search ..... 292/216, DIG. 38, 341.12, 292/DIG. 56, DIG. 73, DIG. 55; 70/463

[56] References Cited

U.S. PATENT DOCUMENTS

| | | | |
|---|---|---|---|
| 151,359 | 5/1874 | Davies | 70/463 |
| 1,347,110 | 7/1920 | McDonald | 70/463 |
| 1,592,145 | 7/1926 | Mack | 70/463 |
| 1,595,046 | 8/1926 | Martin | 292/341.12 |
| 1,794,073 | 2/1931 | Hammerl | 292/341.12 |
| 1,923,688 | 8/1933 | Rightmyer | 70/463 |
| 2,047,425 | 7/1936 | Menges | 292/341.12 |
| 2,176,043 | 10/1939 | Anderson | 292/DIG. 38 X |
| 2,637,580 | 5/1953 | Roethel | 292/341.12 |
| 4,073,519 | 2/1978 | Kurozu et al. | 292/DIG. 56 X |
| 4,165,112 | 8/1979 | Kleefeldt | 292/341.12 X |
| 4,357,039 | 11/1982 | Tölle | 292/DIG. 56 X |
| 4,358,141 | 11/1982 | Hamada | 292/DIG. 56 X |
| 4,586,737 | 5/1986 | Arlauskas | 292/216 |

FOREIGN PATENT DOCUMENTS

| | | | |
|---|---|---|---|
| 1964260 | 10/1970 | Fed. Rep. of Germany | 292/341.12 |
| 1923974 | 11/1970 | Fed. Rep. of Germany | 292/DIG. 38 |

*Primary Examiner*—Lloyd A. Gall
*Attorney, Agent, or Firm*—Lalos & Keegan

[57] ABSTRACT

In a vehicle door assembly including a bolt projecting from a sidewall of a door opening of the vehicle, a latch having a pair of leg section defining a bolt receiving recess rotatably mounted on a sidewall of the door member, a spring operatively interconnecting the door sidewall and the latch for rotatably biasing the latch in an unlocked position with the recess registered with the bolt, a retaining pawl having a hook section engageable with contact portions of the latch leg sections when the leg sections are disposed in pre-locking and fully locking positions, rotatably mounted on the door side member and a spring operatively interconnecting the door sidewall and the retainer pawl for rotatably biasing the retaining pawl in a direction toward the latch, the improvement consisting of the latch being coated with a sound absorbing material except for spaced segments disposed along with periphery of the latch recess.

10 Claims, 2 Drawing Sheets

VEHICLE DOOR LOCK ASSEMBLY

BACKGROUND OF THE INVENTION

This invention relates to a vehicle door lock assembly and more particularly to such an assembly provided with sound abating means.

In the prior art, there has been developed a type of door lock assembly for vehicles which generally includes a bolt mounted on the rear side wall of the door opening of the vehicle, a rotary latch mounted on a side wall of the door which is operatively engageable with the bolt for holding the door in the closed position, and a pawl also mounted on the door sidewall which is operatively engageable with the latch for retaining the latch in the closed position. Normally, such lock components are formed of a metal having sufficient strength properties to withstand impact loads applied in the direction of travel of the door and also in a direction perpendicular to the direction of door travel.

Because of the noise resulting from the striking lock components during opening and closing of the door, it has become a common practice in the industry to coat the latch member of such an assembly with a noise absorbing or deadening material such as plastic. It has been found, however, that in order to maintain the strength properties of the components for safety purposes, coating materials of greater strength but lesser sound absorbing properties must be used which is undesirable from a noise abatement point of view. It also has been the practice of some vehicle manufacturers to provide the bolt member of such assemblies with a noise absorbing material, usually a plastic, to further deaden the noise resulting from the components striking each other. Such provision also has been found not to be satisfactory in performance in that after a period of service, the coating material on the bolt member wears or spalls.

It thus has been found to be desirable to provide a lock assembly of the type described which not only has optimum sound abating characteristics but also optimum strength properties sufficient to withstand impact loads applied to the vehicle, particularly during collision, both transversely and longitudinally.

SUMMARY OF THE INVENTION

Accordingly, it is the principal object of the present invention to provide an improved lock assembly for vehicle doors.

Another object of the present invention is to provide a lock assembly for a vehicle door which performs safely and operates quietly.

A further object of the present invention is to provide an improvement in a door lock assembly for a vehicle in which the components thereof are coated with a sound absorbing or deadening material.

A still further object of the present invention is to provide an improved door lock assembly for a vehicle having optimum strength properties consistent with optimum sound absorbing characteristics.

A further object of the present invention is to provide an improved door lock assembly for a vehicle, utilizing a coating of sound absorbing material on the components thereof for reducing noise, in which coating materials of high sound absorbing properties can be used without sacrificing the strength properties of the components.

Other objects and advantages of the present invention will become more apparent to those persons having ordinary skill in the art to which the present invention pertains from the following description taken in conjunction with the accompanying drawings in which:

DETAILED DESCRIPTION OF THE PREFERRED EMBODIMENT

Figure 1:
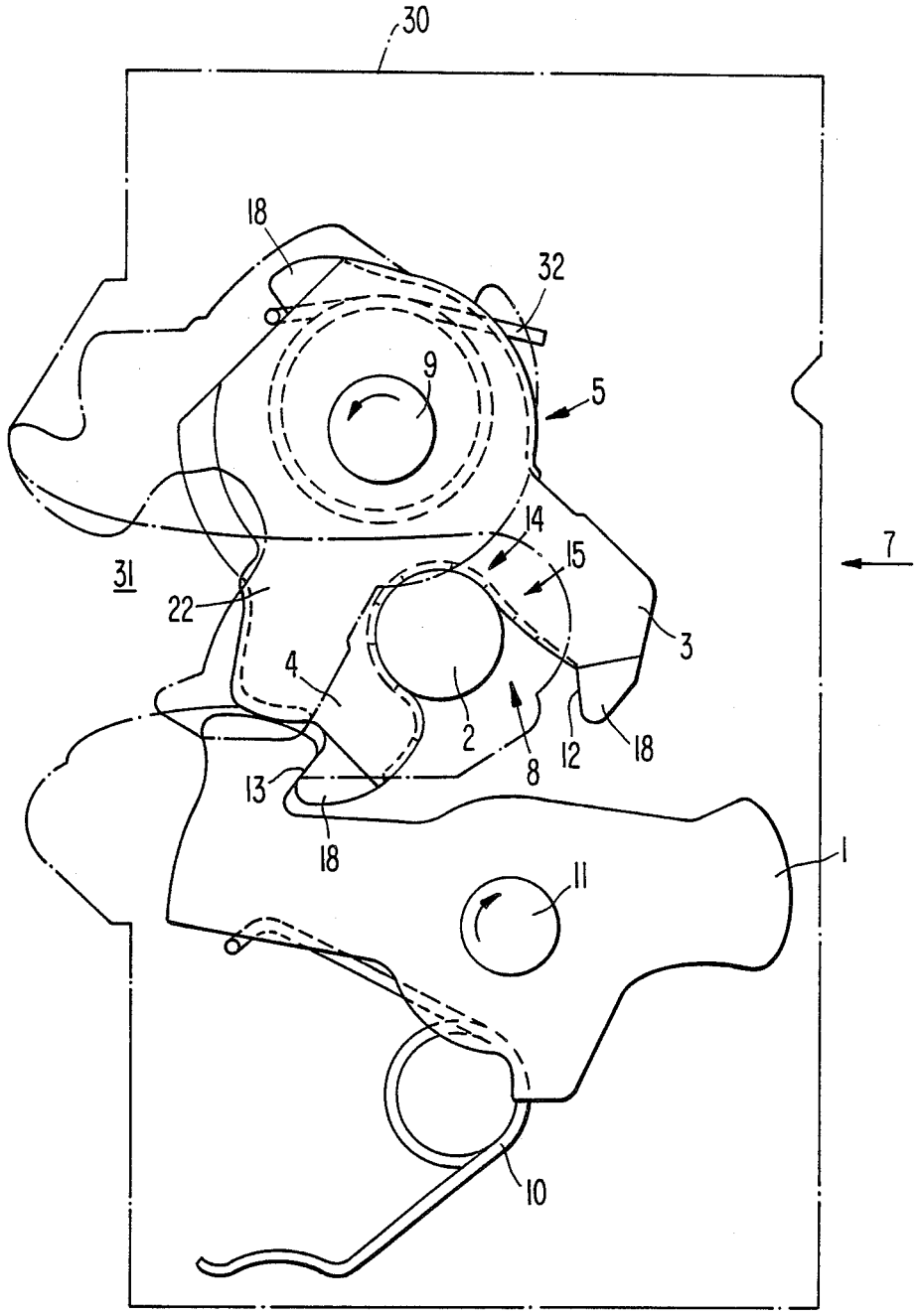
FIG. 1 is a side-elevational view of a door lock assembly of a vehicle embodying the present invention.

Referring to the drawings, there is shown a door locking assembly for a vehicle embodying the present invention which includes a retaining pawl 1, a bolt 2 and a latch 5. The latch is rotatably mounted on a shaft 9 secured to a housing 30 mounted on a sidewall of the vehicle door, and is rotatably biased in a clockwise direction relative to FIG. 1 by means of a spring 32 operatively interconnecting latch 5 and housing 30. It is provided with a pair of leg sections 3 and 4 defining a recess 8 therebetween which is adapted to receive bolt 2 therein. The bottom of recess 8 is arcuately configured and has a radius substantially the same as the radius of bolt 2. When the door is in the open position and the assembly is in the unlocked condition, spring 32 functions to bias latch 5 in the position depicted in phantom lines in FIG. 1 with recess 8 being disposed as at 31, transversely registered with bolt 2.

Figure 3:
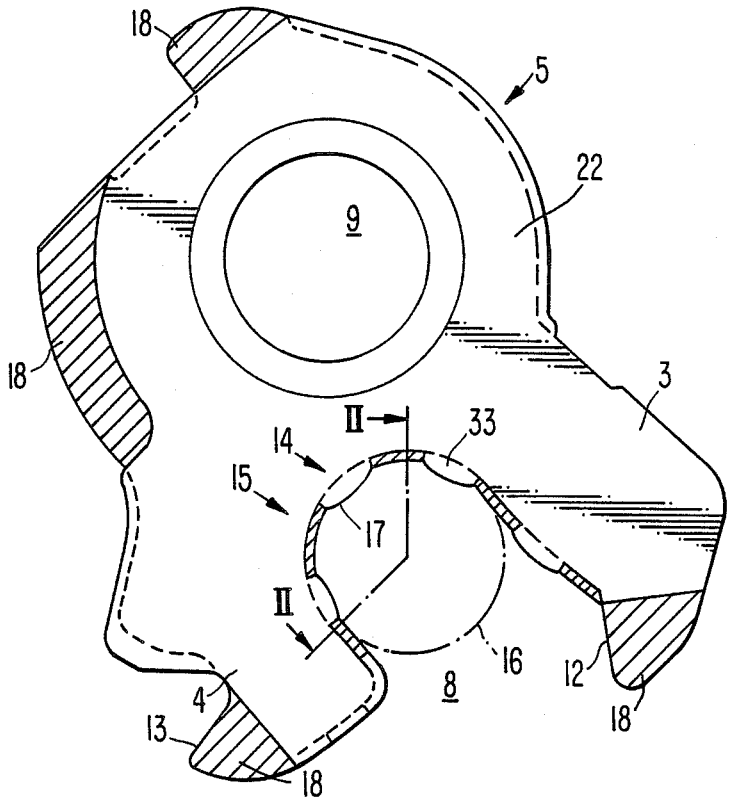
FIG. 3 is an enlarged side-elevational view of the latch member shown in FIG. 1.

As best shown in FIG. 3, the periphery of recess 8 is provided with a plurality of spaced recesses 33, and the core 18 of the latch is coated with a sound absorbing material 22 except for certain portions including segments 15 disposed between coating segments 14 disposed in peripheral recesses 33, and the end portions of leg sections 3 and 4 providing pawl engaging contact surfaces 12 and 13. In addition to the periphery of recess 8 having alternately coated and uncoated segments 14 and 15, the outer portions of coated segments 14 are provided with a convex or crowned configuration so that such segments project slightly into recess 8. Such portions project slightly inwardly of a circular line 16 which has substantially the same diameter as bolt 2.

Retaining pawl 1 is secured to a shaft 11 mounted on housing 30. It is biased in clockwise direction relative to FIG. 1 by a spring 10 operatively interconnecting the pawl and housing 30. The pawl is provided with a protruding hook section adapted to be cammed downwardly by latch leg sections 3 and 4 when the latch is rotated in a counter-clockwise direction, and to engage contact surfaces 12 and 13 of latch leg sections 3 and 4 when the latch leg sections trip over the pawl hook portion.

In the operation of the assembly as described, when the door handle is operated to rotate the pawl in a counter-clockwise direction and release the latch, and the door is pulled or pushed open, the latch will rotate in a clockwise direction under the biasing action of spring 32 to the unlocked position as shown in phantom lines in FIG. 1 with recess 8 positioned as shown at 31. When the door is pulled or pushed in the closing direction as shown by the arrow 7, latch leg section 3 will first engage and cam the pawl hook section downwardly allowing leg section 3 to trip over the pawl hook section. Once this occurs, the biasing action of springs 10 and 32 will cause contact surface 12 of leg section 3 to engage the backside of the pawl hook section and the assembly will be in a partially locked or pre-indexing condition and the door will be in a partially closed condition. As the door continues to be moved in the direction of arrow 7, latch leg section 4 will then cam down and trip over the pawl hook section. At such point, the biasing action of springs 10 and 32 will cause contact surface 13 of leg section 4 to engage the backside of the pawl hook section and the assembly will be in a fully locked or fully indexed condition and the door will be in fully closed position, as shown in FIG. 1.

In the course of the operation of the assembly as described, it will be noted that the contact areas of the latch, bolt and pawl members provide metal-to-metal contact thus assuring tight and secure engagement. Segments 14 of coating material about the periphery of recess 8, however, provide a substantial noise abatement effect without materially adversely affecting the strength properties of the assembly. The engagement thus permits the selection of a coating material for the latch member having optimum sound absorbing properties which results in a door lock assembly having optimum noise abating capabilities consistent with optimum strength properties.

Figure 2:
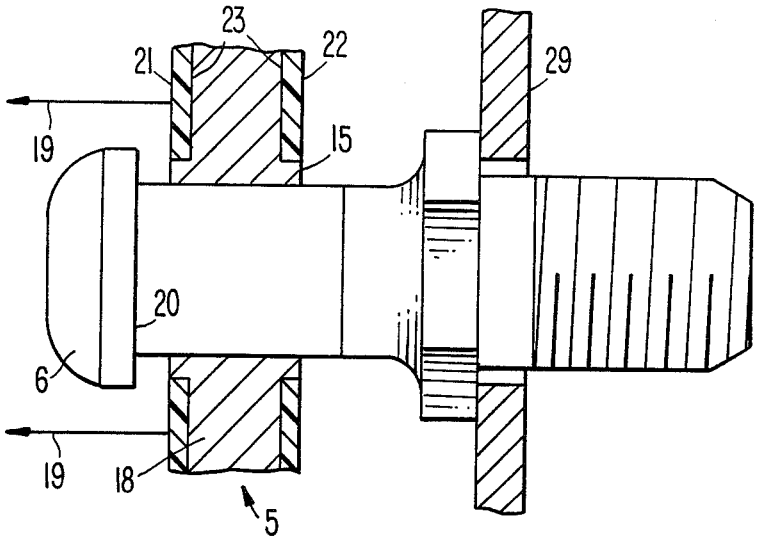
FIG. 2 is a partial cross-sectional view taken along line II—II in FIG. 3.

Preferably, the face portions of latch 5 are recessed as shown at 23 in FIG. 2 in which there is applied coatings of the sound deadening material. The depth of recesses 23 is approximately the same as the thickness of coating 22. Upon application of an impact load in the direction of arrows 19 shown in FIG. 2, the edge portions of face portion 21 adjacent recess 8, will engage an annular surface area 20 provided by enlarged bolt head section 6. The side surfaces of coated and exposed segments 14 and 15 of the latch member will engage annular surface 20 to effectively engage and transmit forces yet provide for long wear and sound deadening effects.

Since the coated portions of the latch member have minimal contact with the metallic surfaces of the bolt, the selection of a coating material need not be limited to materials having high strength characteristics which usually have low noise absorbing properties. In fact, materials having high noise absorbing properties may be selected to optimize the quiet operation of the assembly. Preferably, the coating material consists of a plastic material having high sound absorbing characteristics such as a polyester elastomer.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. In a vehicle door assembly including a bolt projecting from a sidewall of a door opening in the body of a vehicle, a metallic latch having a pair of leg sections defining a bolt receiving recess, rotatably mounted on a sidewall of a door member hingedly mounted in said door assembly, means operatively interconnecting said door sidewall and said latch for rotatably biasing said latch in an unlatched position with said recess registered with said bolt, a metallic retaining pawl having a hook section engageable with contact portions of said latch leg sections when said leg sections are disposed in prelocking and fully locking positions, rotatably mounted on said door sidewall, and means operatively interconnecting said door sidewall and said retaining pawl for rotatably biasing said retaining pawl in a direction toward said latch, the improvement comprising the left receiving recess of said latch being coated with a sound absorbing material except for a plurality of spaced segments disposed along the periphery thereof.

2. The improvement according to claim 1 wherein the periphery of the recess of said latch engageable with said bolt includes spaced recesses, and said coating material is disposed in said spaced recesses to provide alternating segments of metal and coating material.

3. The improvement according to claim 2 wherein said segments of coating material project beyond a boundary line of said metallic segments.

4. The improvement according to claim 3 wherein said segments of coating material are provided with crowned configurations.

5. The improvement according to claim 1 wherein other surface portions of said latch are recessed and said coating material is disposed therein.

6. The improvement according to claim 1 wherein said coating material comprises a plastic having high noise absorbing properties.

7. The improvement according to claim 6 wherein said plastic material comprises a polyester elastomer.

8. The improvement according to claim 1 wherein portions of the leg sections of said latch engageable with said retaining pawl are uncoated with said coating material.

9. The improvement according to claim 1 wherein said bolt includes an enlarged head portion and said latch includes an uncoated portion engageable with said head portion upon an impact load being imposed on said door in a direction disposed substantially perpendicular to the direction of travel of said door.

10. The improvement according to claim 1 wherein side surfaces of metallic and coated material segments disposed about the periphery of said latch recess are engageable with an annular surface provided by an enlarged head portion of said bolt when said bolt is received in said latch recess and the assembly is in the locking position.

* * * * *

UNITED STATES PATENT AND TRADEMARK OFFICE

CERTIFICATE OF CORRECTION

PATENT NO. : 4,783,103

DATED : November 8, 1988

INVENTOR(S) : Christoph Schlegel

It is certified that error appears in the above-identified patent and that said Letters Patent is hereby corrected as shown below:

In Claim 1, at column 4, line 17, the word "left" should read -- bolt --.

Signed and Sealed this

Seventh Day of March, 1989

*Attest:*

DONALD J. QUIGG

*Attesting Officer*

*Commissioner of Patents and Trademarks*